US009494060B2

(12) United States Patent
Taylor et al.

(10) Patent No.: US 9,494,060 B2
(45) **Date of Patent: *Nov. 15, 2016**

(54) VALVE TIMING CONTROL

(71) Applicant: Hitachi Automotive Systems Americas Inc., Harrodsburg, KY (US)

(72) Inventors: Kenneth Taylor, Redford, MI (US); Andrew Turner, Lasalle (CA)

(73) Assignee: Hitachi Automotive Systems Americas Inc., Harrodsburg, KY (US)

( * ) Notice: Subject to any disclaimer, the term of this patent is extended or adjusted under 35 U.S.C. 154(b) by 103 days.

This patent is subject to a terminal disclaimer.

(21) Appl. No.: 14/548,933

(22) Filed: Nov. 20, 2014

(65) Prior Publication Data

US 2015/0075464 A1 Mar. 19, 2015

Related U.S. Application Data

(63) Continuation of application No. 13/652,719, filed on Oct. 16, 2012, now Pat. No. 8,915,221.

(51) Int. Cl.
*F01L 1/34* (2006.01)
*F01L 1/344* (2006.01)

(52) U.S. Cl.
CPC ..... *F01L 1/3442* (2013.01); *F01L 2001/3445* (2013.01)

(58) Field of Classification Search
CPC ..... F01L 1/3442; F01L 2001/3445
USPC ..... 123/90.15, 90.17
See application file for complete search history.

(56) References Cited

U.S. PATENT DOCUMENTS 6,412,462 B1 7/2002 Lichti et al.
6,758,776 B2 7/2004 Fye et al.
8,915,221 B2 * 12/2014 Taylor ..... F01L 1/3442 123/90.15

* cited by examiner

*Primary Examiner* — Ching Chang
(74) *Attorney, Agent, or Firm* — Dinsmore & Shohl LLP; Douglas W. Sprinkle

(57) ABSTRACT

A valve timing control having a stator body constructed of a plastic material. The stator body has an annular side wall and a front plate which, together, define a plurality of annularly spaced internal cavities within the stator body. A rotor having a plurality of vanes is positioned within the stator body so that one vane is positioned within each cavity. The rotor is movable relative to the stator body between a first and second rotational position. A plurality of threaded metal inserts are embedded within the stator body and used to attach a metal sprocket to the stator body at a position opposed to the front plate. Two of these inserts also receive the impact load from the rotor.

7 Claims, 4 Drawing Sheets

VALVE TIMING CONTROL

CROSS-REFERENCE TO RELATED APPLICATIONS

This application is a continuation of U.S. patent application Ser. No. 13/652,719 filed Oct. 16, 2012.

BACKGROUND OF THE INVENTION

I. Field of the Invention

The present invention relates to a valve timing control for an internal combustion engine.

II. Description of Related Art

In order to improve engine performance as well as enhance fuel economy, many internal combustion engines utilize a valve timing control to vary the valve timing as a function of the engine operating conditions. Typically, the valve timing control includes a stator body having a plurality of annularly spaced interior cavities. A rotor having a plurality of vanes is disposed within the stator body so that one vane is positioned within each cavity of the stator body. The rotor is rotatable between a first and second rotational position relative to the stator body. Furthermore, the rotor is coupled to the camshaft which controls the opening of the engine valves. Consequently, the timing of the valve openings relative to the crankshaft may be varied by varying the relative rotational position of the rotor relative to the stator body. This relative rotational position of the rotor relative to the stator body is typically controlled hydraulically.

In order to rotatably drive the valve timing control, a sprocket is conventionally attached to the stator body and mechanically coupled to the engine crankshaft via a belt or chain. The sprocket, stator body, and rotor thus rotate in unison with each other except that the angular offset between the stator body and the rotor may be varied.

The valve timing control is subjected to a great deal of mechanical and thermal stress during operation. For example, during engine startup the valve timing control is typically not pressurized with hydraulic fluid. Consequently, the rotor freely rotates relative to the stator body and mechanically impacts the stator body for a short period of time following engine startup.

Since the valve timing control is subjected to both high mechanical and thermal stresses during operation, it has been the previous practice to construct the stator body and rotor from metal. A metal stator body is able to withstand both the mechanical impacts from the rotor as well as the thermal conditions during ordinary operation without undue expansion or warpage.

The use of metal for the valve timing control, however, can disadvantageously increase the overall cost for the valve timing control, but also the weight for the valve timing control.

In order to decrease both the cost and the weight of the valve timing control, there have been previously known efforts to utilize plastic materials for the stator body. These previously known attempts, however, have not proven wholly satisfactory.

More specifically, in one previously known valve timing control, a front plate for the stator housing was replaced with a plastic material. While this achieved some reduction in overall weight and cost for the stator housing, the overall savings in weight and cost were minimal.

The use of inexpensive plastic material for the stator housing has also proven unsuccessful. Such low cost plastic materials are simply unable to withstand the impact from the rotor, especially at engine startup. Furthermore, such plastic materials deform during the elevated temperatures present in the normal operation of the valve timing control. Such deformation of the stator housing for the valve timing control may result not only in destruction of the valve timing control, but potentially engine failure.

There are, however, certain plastic resins that are able to withstand the high temperatures present in the environment of the valve timing control without unacceptable deformation. However, these previously known plastic resins, such as PEEK, are not cost effective and do not have production feasibility.

SUMMARY OF THE PRESENT INVENTION

The present invention provides a valve timing control having a stator housing constructed of a low cost plastic and yet capable not only of withstanding the mechanical impact during operation of the valve timing control, but also able to withstand elevated operating temperatures without failure of the valve timing control.

In brief, the present invention provides a valve timing control having a stator body constructed of a plastic material. The stator body includes an annular side wall having a plurality of annularly spaced cavities and a front plate. A rotor is coaxially mounted within the stator body and includes a plurality of radially outwardly extending vanes with one vane positioned within each cavity of the stator body. The rotor, furthermore, is mechanically coupled to the camshaft for controlling the opening and closing of the engine valves. This rotor is also movable between a first and second rotational position relative to the stator housing to thereby vary the valve timing for the engine.

A plurality of threaded metal inserts are embedded in the stator body. These threaded inserts thus enable a metal sprocket to be attached to the stator body by a plurality of fasteners, such as bolts, extending through the sprocket and threadably engaging the metal inserts. Since the fastener and inserts provide a metal-to-metal engagement for securing the sprocket to the stator body, thermal distortion of the stator body during high temperature operating conditions will not affect the connection of the sprocket with the stator housing or the operation of the valve timing control.

Conventionally, only one vane of the rotor physically contacts the sides of its associated cavity in the stator body. In order to protect the stator body from impacts from the rotor, especially during engine startup, a portion of two of the inserts forms a part of the cavity wall. Consequently, during engine startup and before the cavities in the stator body are filled with hydraulic fluid, the rotor impacts not against the stator housing constructed of plastic material, but rather against the metal inserts. These metal inserts are able to withstand the impact of the rotor and protect the stator body from impact damage.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figures 1, 2:
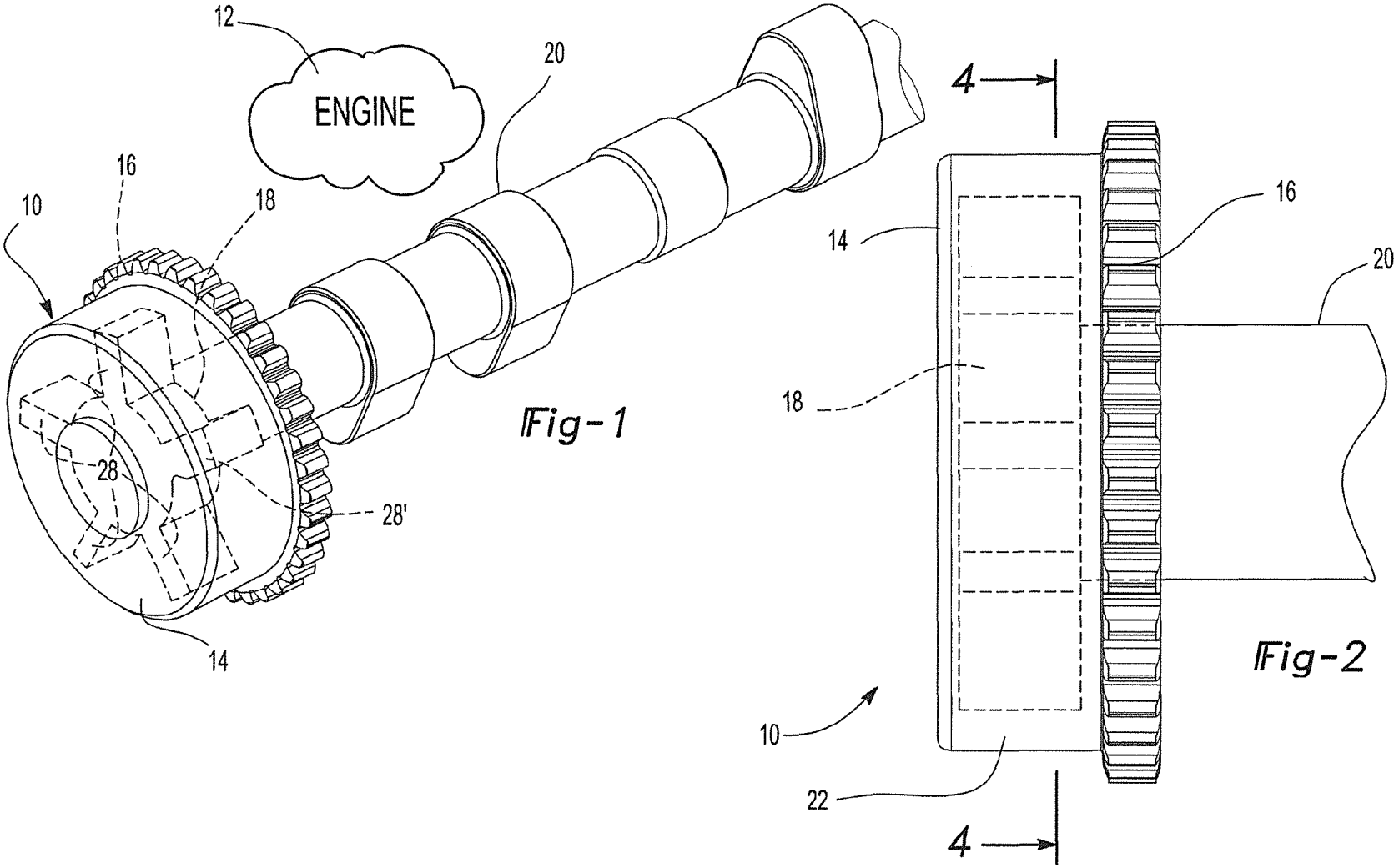
FIG. 1 is an elevational view illustrating the valve timing control of the present invention in its operating environment.
FIG. 2 is a fragmentary side view of the valve timing control.
Figure 3:
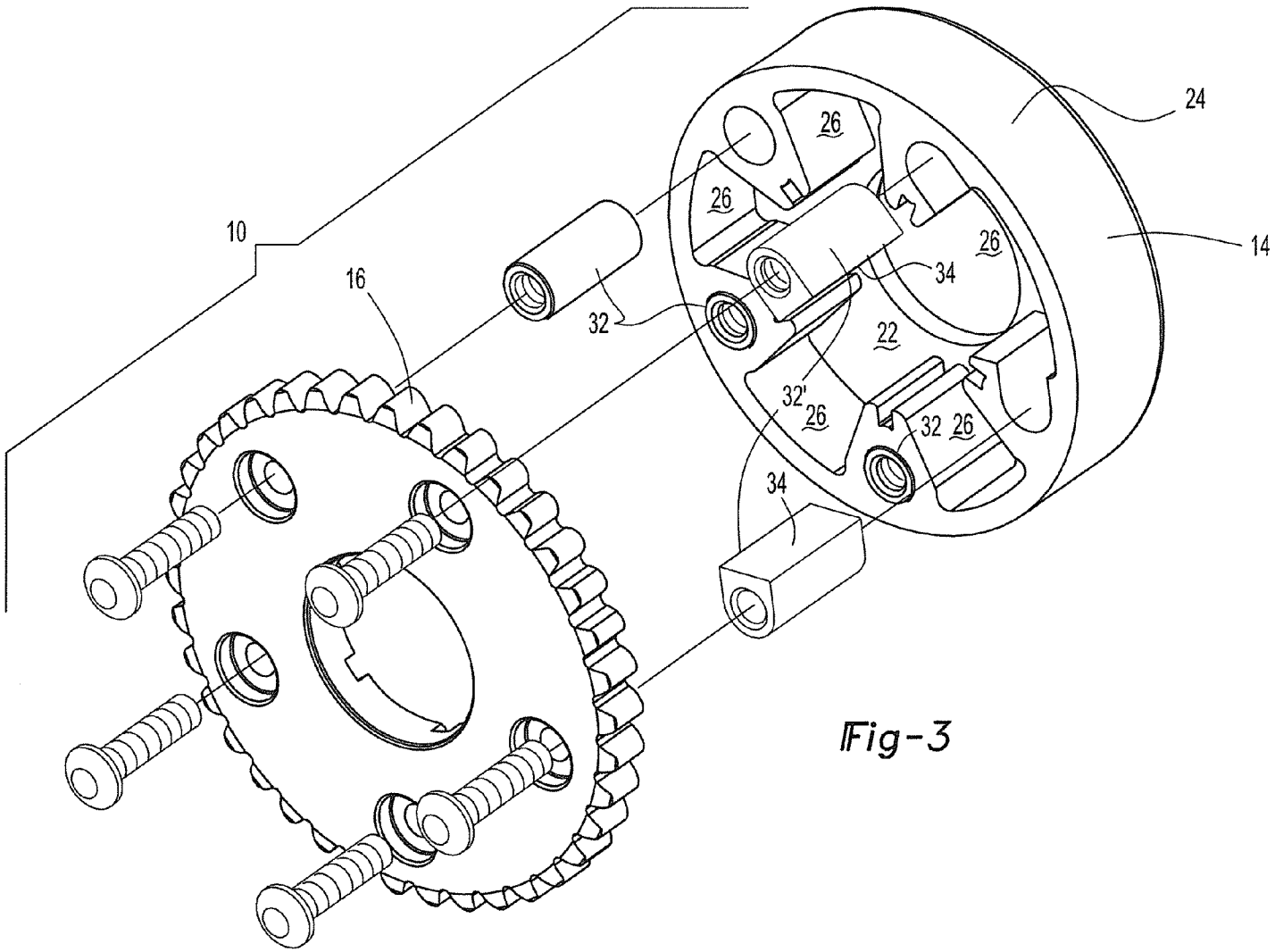
FIG. 3 is an exploded view illustrating the valve timing control of the present invention.

With reference first to FIGS. 1-3, an exemplary valve timing control 10 according to the present invention is shown in conjunction with an internal combustion engine 12 (illustrated diagrammatically). The valve timing control 10 includes a stator body 14 having a sprocket 16 attached to one end of the stator body 14. A rotor 18 contained within the interior of the stator body 14 is mechanically coupled to a camshaft 20 which, in turn, controls the opening and closure of the engine valves in the well-known fashion. However, as will become hereinafter apparent, the rotor 18, and thus the camshaft 20, are rotatable between a first and second rotation relative to the stator body 14. This variable rotational position of the camshaft 20 relative to the stator body 14 varies the valve timing for the engine 12 relative to the crankshaft angle.

Figure 4:
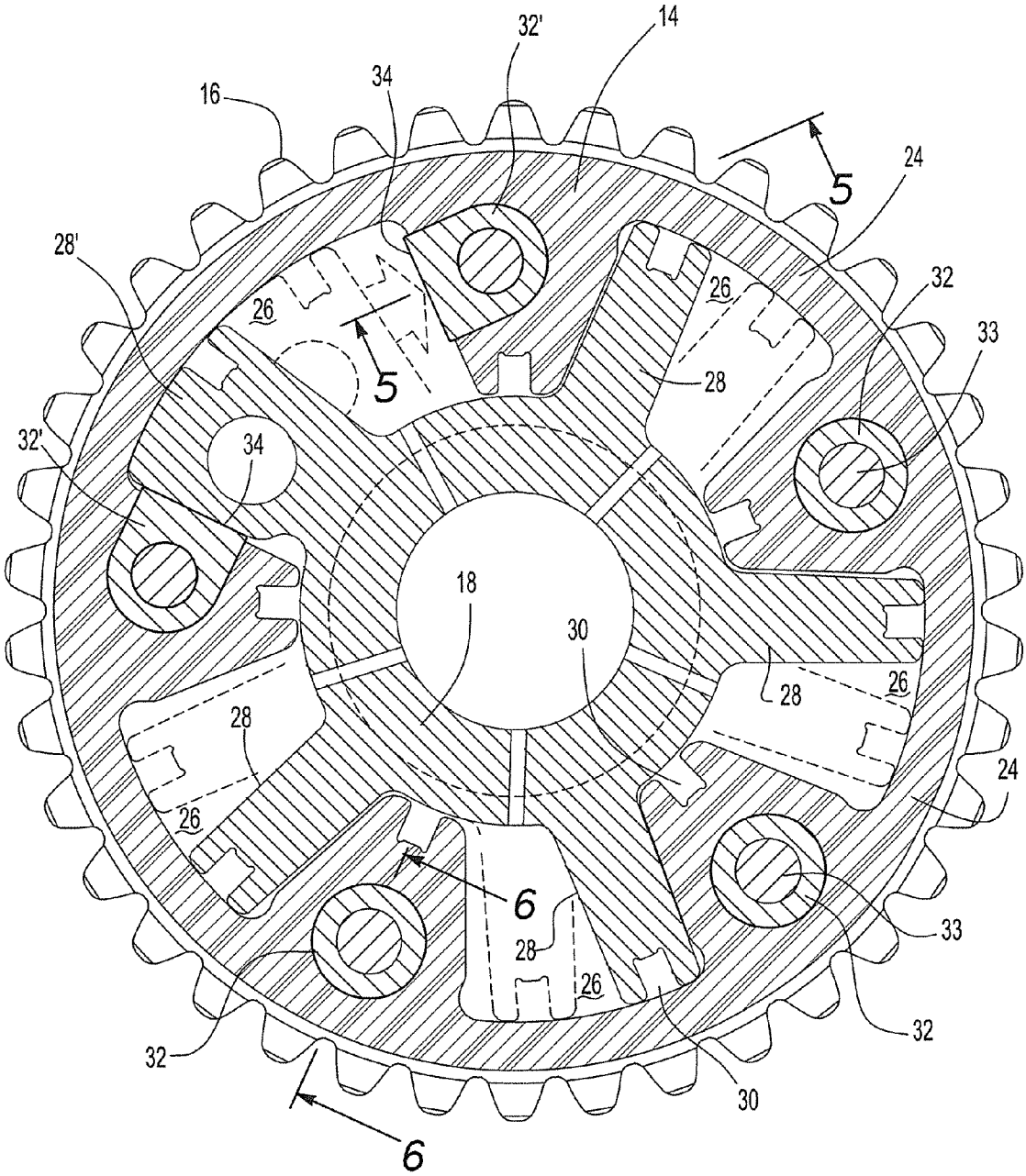
FIG. 4 is a sectional view taken along line 4-4 in FIG. 2.

With reference now to FIGS. 2-4, the stator housing 14 includes both a front plate 22 and an annular side wall 24. As best shown in FIGS. 3 and 4, this annular side wall 24 forms a number of annularly spaced fluid chambers 26 within the stator body 14. The rotor 18 also includes a plurality of radially outwardly extending vanes 28 wherein each vane 28 is positioned within its associated cavity 26 and fluidly sealed to the stator body 14 by fluid seals 30.

The rotor 18 is rotatable between a first rotational position, illustrated in solid line in FIG. 4, and a second rotational position, illustrated in phantom line in FIG. 4 relative to the stator body 14. However, only one vane 28' of the rotor 18 contacts the sides of its associated cavity 26 at each of its two extreme rotational positions relative to the stator body 14.

The valve timing control 10 thus far described is conventional in construction. However, unlike the previously known valve timing controls, in the present invention both the front plate 22 and annular side wall 24 of the stator body 14 are constructed of a low cost plastic material and preferably a plastic resin. Moreover, the front plate 22 and annular wall 24 which forms the cavities 26 for the rotor vanes 28 are of a one-piece construction and preferably formed by molding.

Figure 6:
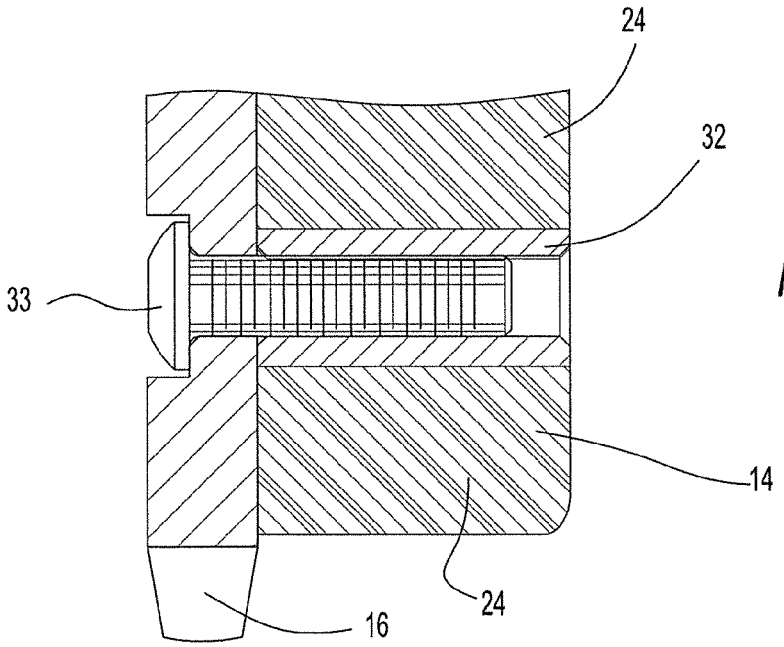
FIG. 6 is a fragmentary sectional view taken along line 6-6 in FIG. 4.

With reference to FIGS. 3, 4, and 6, in order to attach the sprocket 16 to the stator body 14 and maintain sufficient mechanical strength despite thermal deformation, a plurality of internally threaded metal inserts 32 are embedded within the stator body side wall 14 at circumferentially spaced locations around the side wall 24 of the stator body 14. Preferably, one metal insert 32 is embedded in the side wall 24 between each pair of adjacent cavities 26 in the stator body 14.

With the metal inserts 32 embedded within the plastic stator body, the sprockets 16 may then be rigidly secured to the stator housing by threaded fasteners 33, such as bolts, extending through the sprocket 16 and threadably engaging the inserts 32. Consequently, even if the stator body 14 is subjected to thermal distortion, the mechanical connection between the sprockets 16 and the stator body 14 through the metal inserts 32 will remain secure.

Figure 5:
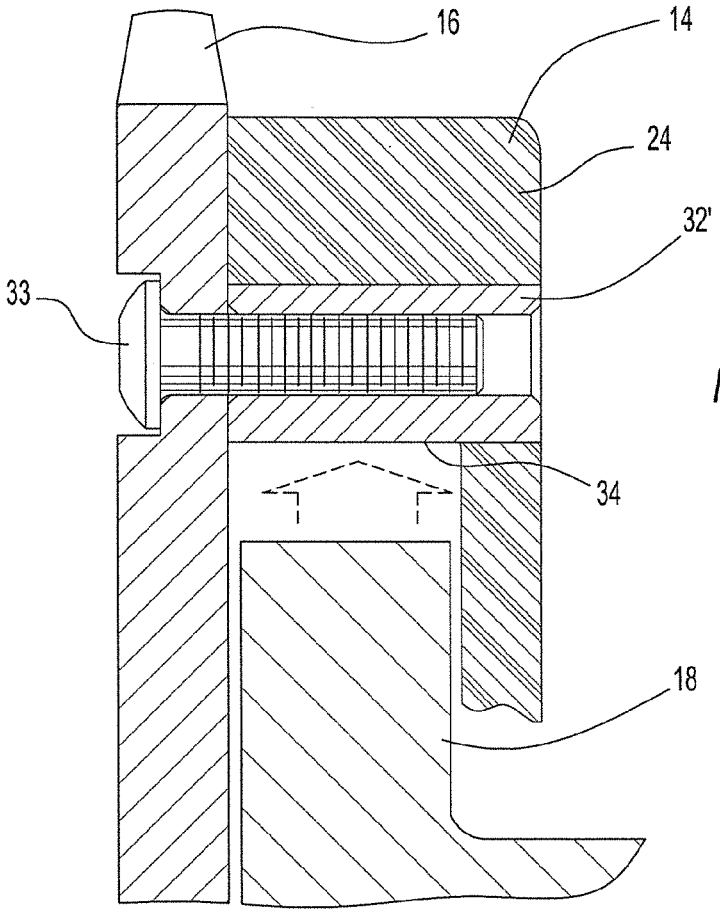
FIG. 5 is a fragmentary sectional view taken along line 5-5 in FIG. 4.

With reference now particularly to FIGS. 3, 4, and 5, in order to protect the stator body 14 from mechanical impact by the rotor 18, particularly at engine startup, two of the metal inserts 32' each have a relatively flat surface 34 which is either flush with, or protrudes slightly outwardly from, the stator side wall walls 14 containing the rotor vane 28'. Consequently, as the rotor vane 28' contacts the sides of its associated cavity 26, especially at engine startup, the vane 28' contacts the sides 34 of the metal inserts 32' rather than the plastic stator body 14 thus protecting the stator body 14 from mechanical damage. Such damage might otherwise be caused by the impact of the vane 28' against the side walls forming the cavity 26 of the stator body 14 but for the metal inserts 32'.

From the foregoing, it can be seen that the present invention provides a valve timing control with a one piece stator body that is constructed of a lightweight, inexpensive plastic material and yet retains sufficient strength and rigidity due to the metal inserts to withstand not only the elevated operating temperatures sometimes present in its operating environment, but also able to withstand mechanical impacts from the rotor. Having described our invention, however, many modifications thereto will become apparent to those skilled in the art to which it pertains without deviation from the spirit of the invention as defined by the scope of the appended claims.

We claim:

1. A valve timing control comprising:

a stator body constructed of a plastic, the stator body having an annular side wall and a front plate, a plurality of threaded metal inserts embedded in the stator body, and a rotor having a plurality of vanes, wherein one of the vanes contacts a side of one of said threaded metal inserts rather than the stator body.

2. The valve timing control as defined in claim 1 wherein said side of said one threaded metal insert protrudes outwardly from said stator body.

3. The valve timing control as defined in claim 1 wherein said one vane has a greater circumferential width than the other of said plurality of vanes.

4. The valve timing control as defined in claim 1 wherein said stator body includes a plurality of fluid chambers, each chamber receiving a single vane of said plurality of vanes, and wherein said one metal insert is positioned substantially centrally in said stator body in the radial direction and wherein said side of said one metal insert is positioned closely adjacent a radial outer side of said fluid chamber.

5. The valve timing control as defined in claim 1 wherein said stator body includes a plurality of fluid chambers, each chamber receiving a single vane of said plurality of vanes, and wherein a perpendicular centerline passing through said side of said one metal insert intersects an outer periphery of said stator body without passing through said fluid chambers.

6. The valve timing control as defined in claim 1 wherein said one metal insert is positioned substantially centrally in said stator body in the radial direction.

7. The valve timing control as defined in claim 1 wherein said stator body includes a plurality of fluid chambers, each chamber receiving a single vane of said plurality of vanes, and wherein said one metal insert is positioned substantially centrally in said stator body in the radial direction and substantially centrally between two of said plurality of fluid chambers in the circumferential direction.

* * * * *